United States Patent [19]

Ishigaki et al.

[11] Patent Number: 5,074,962

[45] Date of Patent: Dec. 24, 1991

[54] PROCESS FOR PREPARING CONFIDENTIAL POSTCARD

[75] Inventors: Ryuzo Ishigaki, Yokohama; Teluhisa Miki, Kawanoe, both of Japan

[73] Assignees: Japan Pulp and Paper Co. Ltd.; Miki Tokushu Paper Mfg. Co., Ltd.; ECS-88 Co., Ltd., all of Japan

[21] Appl. No.: 623,194

[22] Filed: Dec. 6, 1990

Related U.S. Application Data

[63] Continuation-in-part of Ser. No. 319,952, Mar. 7, 1989, abandoned.

[30] Foreign Application Priority Data

| | | | |
|---|---|---|---|
| Jul. 7, 1988 | [JP] | Japan | 63-90467[U] |
| Nov. 7, 1988 | [JP] | Japan | 63-279419 |
| Nov. 30, 1988 | [JP] | Japan | 63-300772 |

[51] Int. Cl.[5] ..... D21F 11/00

[52] U.S. Cl. ..... 162/124; 162/132; 162/134; 162/140; 162/146; 162/196; 229/92.8; 283/100; 283/101; 283/111; 283/116; 283/901

[58] Field of Search ..... 162/140, 129, 123, 134, 162/196, 124; 283/100, 101, 116, 111, 901; 229/92.8; 428/916

[56] References Cited

U.S. PATENT DOCUMENTS

| | | | |
|---|---|---|---|
| 3,953,642 | 4/1976 | Forbess et al. | 162/129 |
| 4,162,180 | 7/1979 | Burton et al. | 162/146 |
| 4,742,954 | 5/1988 | Shishido | 283/111 |
| 4,885,198 | 12/1989 | Kimura | 283/101 |
| 5,005,874 | 4/1991 | Matsuguchi et al. | 283/101 |

FOREIGN PATENT DOCUMENTS

| | | | |
|---|---|---|---|
| 572962 | 10/1945 | United Kingdom | 162/146 |

*Primary Examiner*—Peter Chin

*Attorney, Agent, or Firm*—Charles E. Baxley

[57] ABSTRACT

A process for preparing a confidential postcard contains dehydrating a starting paper material containing 25 to 45% by weight of fibers of a thermoplastic resin and 55 to 75% by weight of fibers of a natural plant to thereby form a paper layer, heating, during or after drying, the paper layer at a temperature not lower than a softening point of the thermoplastic resin fibers to thereby obtain a paper sheet in which the fibers of the thermoplastic resin retain fiber shape and are entangled with the fibers of the natural plant, inscribing a statement to be kept confidential on the paper sheet, superposing the paper sheet to conceal the statement and attaching provisionally the superposed paper sheet by heating under pressure at a temperature not lower than a softening point of the thermoplastic resin fibers to obtain the confidential postcard. The confidential postcard is capable of being peeled off with the statement on the paper sheet being left intact.

14 Claims, 1 Drawing Sheet

PROCESS FOR PREPARING CONFIDENTIAL POSTCARD

CROSS-REFERENCE TO RELATED APPLICATIONS

This application is a continuation-in-part application of Ser. No. 319,952 filed Mar. 7, 1989, now abandoned.

BACKGROUND OF THE INVENTION

This invention relates to a process for preparing a confidential postcard. More particularly, it relates to a process for preparing a confidential postcard, wherein the confidential postcard composed of a certain paper sheet is capable of provisionally adhering by heating and pressurizing the paper sheet and is capable of being subsequently peeled off.

Heretofore, as means for advertisement for marketing or as means for communication in monetary organizations, such as banks, sealed letters enclosed in envelopes are resorted to in order to keep the written contents of postal matters confidential until they reach their destinations. However, with increase in the volume of the postal matters adapted to keep the written contents thereof confidential, it has been tried to conceal the written contents by resorting to postcards that are less expensive than the sealed envelopes. For this reason, various proposals have been made to date.

However, in order that a paper sheet may be handled as a postcard, the writing or printing surfaces of the overall postcard need to adhere in some or other way so as to be peeled off later. Thus, for concealing the written contents on the postal card, it has been proposed that the card be formed in plural layers which are caused to adhere provisionally by an adhesive so as to be peeled off later. However, this known method is economically unmeritorious because it is necessary to carry out the steps of application of an adhesive and subsequent processing. It is also necessary to carry out printing before applying the adhesive, while the dust and dirt may be deposited on the surface of the card coated with the adhesive, thus raising difficulties in handling. On the other hand, a paper sheet which may adhere simply by heating and pressurizing the paper sheet itself without using an adhesive has been disclosed in, for example British Patent 572,962 or U.S. Pat. No. 4,162,180. However, there lacks a concept in these prior-art publications that the paper sheet be used as a postcard, or that paper sheet may be peeled off with the statement previously inscribed on the attached adherent surface is retained, that is, the paper sheet may be attached provisionally. Hence, there is a demand for a confidential postcard which is not in need of an adhesive and which is capable of being peeled off with the statement on the paper sheet being left intact.

SUMMARY OF THE INVENTION

It is a principal object of the present invention to provide a process for preparing a confidential postcard, which may be caused to adhere provisionally without employing an adhesive, and which may also be easily peeled off.

It is another object of the present invention to provide a process for preparing a confidential postcard, wherein written contents can be printed on adhering surfaces and the written contents are not damaged when peeled off.

It is still another object of the present invention to provide a process for preparing a confidential postcard, wherein a writing space is at least about twice that of the ordinary confidential postcard.

The above and other objects of the invention will become apparent from the following description.

According to the present invention there is provided a process for preparing a confidential postcard comprising the steps of:

(a) dehydrating a starting paper material containing 25 to 45% by weight of fibers of a thermoplastic resin and 55 to 75% by weight of fibers of a natural plant to thereby form a paper layer;

(b) heating, during or after drying, the paper layer at a temperature not lower than a softening point of the thermoplastic resin fibers to thereby obtain a paper sheet in which the fibers of the thermoplastic resin retain fiber shape and are entangled with the fibers of natural plant;

(c) inscribing a statement to be kept confidential on the paper sheet;

(d) superposing the paper sheet to conceal the statement; and (e) attaching provisionally the superposed paper sheet by heating under pressure the paper sheet at a temperature not lower than a softening point of the thermoplastic resin fibers to obtain the confidential postcard, whereby the confidential postcard is capable of being peeled off with the statement on the paper sheet being left intact.

PREFERRED EMBODIMENTS OF THE INVENTION

Figure 3A:
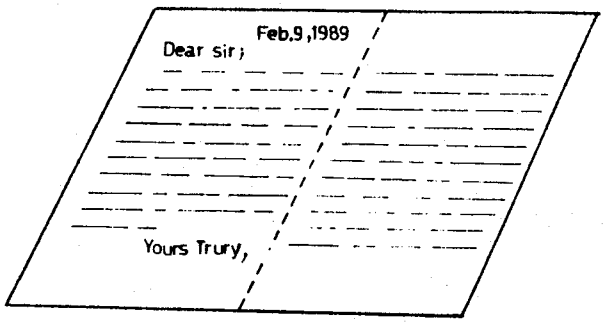
FIG. 3*a* is a diagrammatic perspective view showing an example in which a confidential postcard is obtained by a process of the present invention.

The present invention will be explained in detail hereinbelow.

The process according to the present invention contains steps (a) to (e). In the step (a), a starting paper material containing fibers of a thermoplastic resin and fibers of a natural plant which are mixed under a certain relative content ratio is dehydrated to thereby form a paper layer.

Examples of the aforementioned thermoplastic resin of which the fibers are made may include resins of polyvinyl compounds, such as polyvinyl alcohol, polyvinylidene, polyvinyl chloride or polyacrylonitrile, polyolefins such as polyethylene or polypropylene, polyamides, polyesters, polyurethane, polyalkylene paraoxybenzoate or polyvinyl pyrrolidone. The natural plant fibers may be selected for example from the group consisting of wood fibers, such as needle-leaf trees or broad-leaf trees, seed wool fibers such as cotton or kapok, bast fibers such as mitsu-mata, paper mulberry, a kind of daphne odora, mulberry tree, jute, flax, hemp, China grass or ramie, leaf fibers such as Manila hemp or sisal, fibers of the Graminede family, such as rice plant straws, rice hulls, bamboo, bagasse or esparto.

As regards the relative amounts of the thermoplastic resin fibers and the natural plant fibers, the amounts of the thermoplastic resin fibers are in the range of from 25 to 45% by weight, while those of the natural plant fibers are in the range of from 55 to 75% by weight. If the amounts of the thermoplastic resin fibers and of the natural plant fibers are less than 25% by weight and more than 75% by weight, respectively, provisional adhesion cannot be achieved after heating and pressurizing so that the paper sheet cannot be utilized as the confidential postcard. On the other hand, if the amounts of the thermoplastic resin fibers are more than 45% by weight and those of the natural plant fibers are less than 55% by weight, adhesion becomes so strong after heating and pressurizing that it becomes difficult to peel off the paper sheet portions. Even if the paper sheet portions can be peeled off, the statement cannot be read with ease because the printing, for example, is peeled off simultaneously.

According to the step (a) of the present invention, fillers and flocculants may be incorporated in addition to the thermoplastic resin fibers and the natural plant fibers for improving smoothness, printability and whiteness and preventing strike-through of the paper sheet for making a confidential postcard. These fillers are preferably selected from the group consisting of, for example, calcium carbonate, magnesium carbonate, calcium magnesium carbonate, silicate, silicic acid, aluminum hydrate, barium sulfate, calcium sulfate, calcium sulfite, titanium dioxide, zinc pigments, and mixtures thereof. The fillers are preferably contained in an amount ranging from 0 to 40 parts by weight to 100 parts by weight of the sum of the amounts of the thermoplastic resin fibers and the natural plant fibers. The amounts of the fillers in excess of 40 parts by weight are not desirable because the strength of the paper sheet is lowered. The flocculants are preferably selected from the group consisting of aluminum sulfate, polyethylene imine, cationic starches, aluminum hydroxide, ferric sulfate, ferrous sulfate, ferric chloride, basic aluminum chloride, zinc chloride, sodium aluminate and mixtures thereof. The flocculants are preferably contained in an amount ranging from 0 to 5 parts by weight to 100 parts by weight of the sum of the amounts of the thermoplastic resin fibers and natural plant fibers. The amounts in excess of 5 parts by weight are not desirable because flocculation among the fibers is intensified and the paper texture becomes non-uniform.

In preparing the paper sheet for making the confidential postcard of the present invention, a starting paper material therefor, namely the thermoplastic resin fibers and natural plant fibers, need to be prepared to produce the paper layer. To this end, it is preferred that the thermoplastic resin fibers and the natural plant fibers be dispersed uniformly separately, while they are in the state of the starting materials, in order to prevent occurrence of the situation in which air bubbles are formed on the surface of the confidential postcard to be produced to detract from smoothness of the paper surface. For dispersing the fibers, the thermoplastic resin fibers are caused to flow in circulating water at 5° to 60° C. for 30 to 90 minutes, using an agitator, such as a pulper, to thereby disperse the thermoplastic resin fibers in water. The natural plant fibers are separately agitated, using an agitater, such as a pulper, washed, processed by a refiner and mixed with the dispersed thermoplastic resin fibers. The fillers and the flocculants may be occasionally added at this time. Preferably, a liquid mixture of the thermoplastic resin fibers and the natural plant fibers is adjusted to a uniform concentration and defoaming agents, such as silicone, ester compounds, paraffin, wax, mineral oils or polyalkylenes and drier peeling agents, such as polyethylene, wax or silicone type agents, are added to the liquid mixture, which is then freed of dust. It is preferred that the fibers be mixed and dispersed to a concentration of 0.1 to 0.5% by weight. The dehydration and the formation of the paper layer may be performed using a well-known cylinder machine or a Fourdrinier machine.

During the step (b) of the present invention, the paper layer is heated, during or after drying, to a temperature not lower than a softening point of the thermoplastic resin fibers to thereby obtain the paper sheet in which the fibers of the thermoplastic resin retain fiber shape and are entangled with the fibers of the natural plant. Such heating may be effected, using a thermal processor, such as, for example, a heat roll or oven furnace type thermal processor. The heat processor may be separated form or integrated with the paper machine. By the temperature not lower than the softening point is meant a temperature at which the thermoplastic resins conform with other thermoplastic resin fibers and with the natural plant fibers contacting therewith, while the thermoplastic resin fibers are in the softened state and retain the fiber shape, and not a temperature at which the thermoplastic resin fibers are melted completely. That the thermoplastic resin fibers conform with other thermoplastic resin fibers and natural plant fibers means a state in which, while the resin fibers retain the fiber shape, the thermoplastic resin fibers heat processed to a temperature not lower than the softening temperature are brought into more intimate contact with the other thermoplastic resin fibers and the natural plant fibers than when the resin fibers are not heat processed, that is, a state in which the paper strength is intensified such that the printing is not impared when the paper sheet formed into a postcard and once caused to adhere provisionally is peeled subsequently. If the heating is below the softening point, the paper sheet formed into a postcard cannot be caused to adhere provisionally, but is caused to adhere completely at the time of provisional adhesion at a temperature not lower than the softening point. On the other hand, if the thermoplastic resin fibers are melted completely, the texture in which the thermoplastic resin fibers and the natural plant fibers are entangled with one another cannot be maintained and the superimposed paper sheet portions are caused to adhere completely at the time of provisional adhesion, thus rendering the peeling difficult. Although the heating temperature may vary with the kinds of the thermoplastic resin fibers, it is usually in the range of from 110° to 240° C.

During the step (c) of the present invention, a statement to be kept confidential is inscribed on the paper sheet.

The statement to be kept confidential on the paper sheet may be inscribed during the step (c) using any known types of the ink. For example, the statement may be inscribed, such as by printing, with use of an ink, above all, the thermohardening ink, more specifically, an ink produced by Taniguchi Ink Manufacturing Co., Ltd. under the trade name of "TC-90".

During the step (d), for superposing the paper sheet on which the statement to be kept confidential has been inscribed, for thereby concealing the statement, the paper sheet with the statement inscribed thereon is superposed on another paper sheet so that the resulting double-layer paper sheet may be of the size of a postcard. Alternatively, the paper sheet having the statement inscribed on a portion thereof may be folded at least once upon the remaining portion of the same paper sheet. In both of these cases, for facilitating the peeling-off operation following provisional adherence or attachment which will be explained subsequently, it is preferred that an unsuperposed portion be provided at least at an end edge portion or at a free end portion of the confidential postcard.

During the step (e) of the present invention, the superposed paper sheet is attached by heating under pressure at a temperature not lower than a softening point of the thermoplastic resin fibers for thereby forming the confidential postcard.

The heating temperature for provisionally attaching the superposed paper sheet is not lower than the softening point of the fibers of thermoplastic resin, depending on the type and the amounts of the thermoplastic resin fibers, and is preferably in the range of 140° to 250° C. The pressure to be applied to the paper sheet may preferably be 0.1 to 3.0 kg/cm (0.5 to 12 kg/cm$^2$) and be applied for 0.2 to 3 seconds, with the use of, for example, a known heat sealer, such as that produced by Rinei-sha KK under the trade name of "HS-1" or by Nippon Laminate Machine KK under the trade name of "Secrepacker-SP-1".

The confidential postcard, which is obtained by the steps (a) to (e) of the present invention, is capable of being peeled off with the previously inscribed statement on the paper sheet being left intact.

The confidential postcard which is obtained by the process for preparing of the present invention contains thermoplastic resin fibers and natural plant fibers as essential ingredients and has a texture in which the thermoplastic resin fibers having been softened and retaining the fiber shape are entangled with the natural plant fibers, so that, when the paper sheet for the postcard of the present invention is superposed and then heated and pressurized under a predetermined temperature and pressure, the thermoplastic resin fibers of the superposed sheet portions are softened moderately to cause provisional adhesion of the surfaces of the superposed sheet portions. Before heating and pressurizing as described hereinabove, the paper sheet does not exhibit any adhesive power and behaves like ordinary paper sheet, so that a statement or message to be kept confidential may be written or printed easily on the sides to be caused to adhere to each other provisionally. After the paper sheet is caused to adhere provisionally and the superimposed portions of the sheet are peeled off from each other, the paper sheet does not exhibit any adhesive power, so that there is no risk of deposition of dust or dirt on the sheet surface.

The paper sheet prepared in accordance with the present invention, may adhere solely by heating and pressurizing and without employing the adhesive, while it behaves like an ordinary paper sheet before heating and pressurizing, so that the statement or message can be formed very easily thereon such as by printing. There is no risk of impairing the printed surface during peeling, while there is also no risk of dust and dirt being deposited on the printed surface, since the adhesive power is lost completely at ambient temperature after peeling. In addition, since the paper sheet for the postcard according to the present invention is used in the superposed state, statement or massage can be written or printed on both sides of the superposed portions. Thus, the confidential postcard which is obtained by the process of the present invention can be used at the same postal charges as those for the ordinary postcard, despite the fact that the space available with the paper sheet for a confidential postcard for statement or message is twice or more that of the ordinary postcard, so that it may possibly be used to take the place of the ordinary sealed envelopes.

EXAMPLES OF THE INVENTION

The present invention will be explained by referring to Examples and Reference Examples. However, these Examples are given only for the sake of illustration and are not intended for limiting the invention.

REFERENCE EXAMPLE 1

50 parts by weight of bleached Kraft pulp from needle-leaf trees as natural plant fibers were charged into a pulper. After stirring, the fibers were washed roughly and subjected to a refining treatment. 40 parts by weight of high pressure polyethylene and 1333 parts by weight of warm water at 60° C. were charged in circulating water for one hour for dispersing the polyethylene fibers. The natural plant fibers subjected to the refining treatment and the dispersed polyethylene fibers were then injected into a mixing chest and admixed with 3 parts by weight of titanium dioxide and 3 parts by weight of aluminum sulfate to effect dispersion of the fibers. The produced paper liquid mixture was then introduced into a concentration adjustment unit for adjusting its concentration so that the fiber contents amounted to 0.4 wt. %. The paper liquid mixture was then admixed with 0.05 part by weight of a defoaming agent and 0.02 part by weight of a drier peeling agent. After dust removal, the fiber concentration was set to 0.3% by weight based on the weight of the total feed material, and the fibers were dispersed to produce a feed liquid paper material.

REFERENCE EXAMPLE 2

A feed liquid paper material was prepared in the same way as in Reference Example 1, except using 70 parts by weight of wood fibers as natural plant fibers and 30 parts by weight of polyester fibers (polyethylene terephthalate, a copolymer of ethylene glycol and terephthalic acid), produced by KK Kuraray under the trade name of "N 720", as thermoplastic resin fibers.

REFERENCE EXAMPLE 3

A feed liquid paper material was prepared in the same way as in Reference Example 1, except using 60 parts by weight of wood fibers as natural plant fibers and 40 parts by weight of polypropylene fibers produced by Daiwa Boseki Co., Ltd. under the trade name of "PZ", as thermoplastic resin fibers.

REFERENCE EXAMPLE 4

A feed liquid paper material was produced in the same way as in Reference Example 1, except using 76 parts by weight of bleached Kraft pulp from needle-leaf trees and 24 parts by weight of polyethylen fibers.

REFERENCE EXAMPLE 5

A feed liquid paper material was produced in the same way as in Reference Example 1, except using 54 parts by weight of bleached Kraft pulp from needle-leaf trees and 46 parts by weight of polyethylene fibers.

EXAMPLE 1

By referring to the drawings, a confidential postcard according to the present invention will be hereinafter explained.

Figure 1:
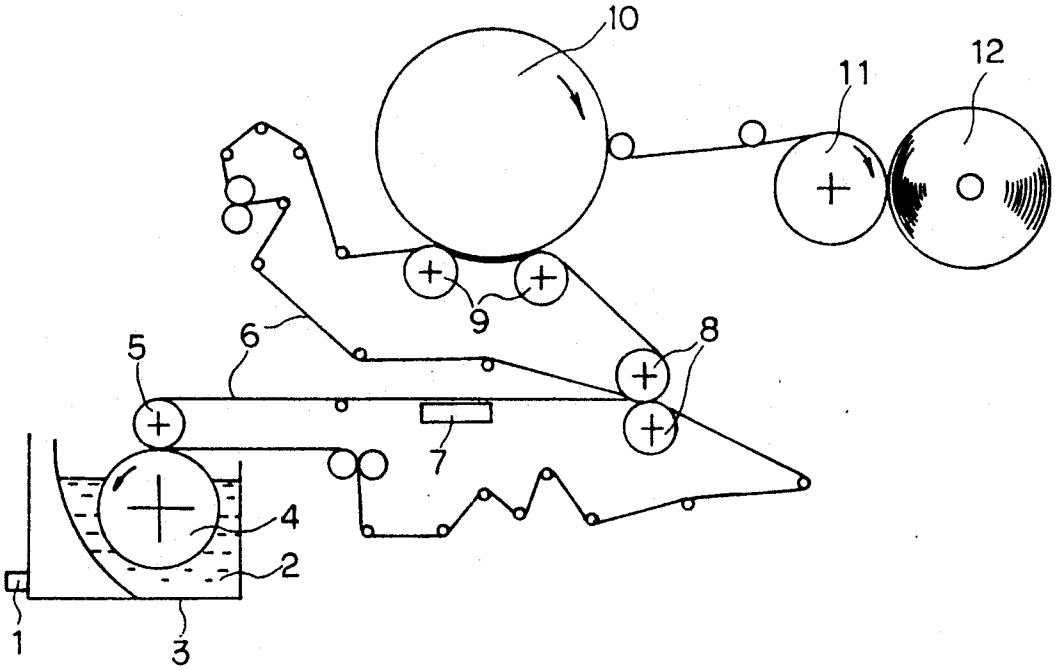
FIG. 1 is a diagrammatic view showing a cylinder type paper making machine employed in an embodiment of the present invention.

In FIG. 1 diagrammatically showing a cylinder paper machine, a cylinder 4 was rotated about its own axis, as a feed liquid paper material 2 prepared in accordance with Reference Example 1 was caused to flow into a paper producing vessel 3. With rotation of the cylinder 4, a difference in the liquid level was produced between the inside and the outside of the cylinder 4 so that hydraulic pressure is applied to the portion of the cylinder 4 dipped in the feed liquid paper material 2, the water flowing from outside into inside of the cylinder to cause fibers to remain on the cylinder surface. As the cylinder 4 exited the feed liquid paper material 2, the meshes of the cylinder 4 were covered by a textured paper layer. As a couch roll 5 was applied to the cylinder 4, this paper layer adhered to a felt layer 6 on the couch roll 5. The paper layer thus adhering to the felt layer was dehydrated in a suction box 7 to a water content of about 20 wt. %, using a vacuum pump. The dehydrated paper layer was further dehydrated in press rolls 8 and transferred automatically to the upper felt layer 6 by a suction pickup device. The thus transferred paper layer then proceeded to touch rolls 9 so as to be affixed to a Yankee drier 10 where it was dehydrated and dried to about 6% by weight of water. For affixing the paper layer to the Yankee drier 10, steam was blown into the interior of the Yankee drier 10 to maintain the mirror finished surface at 110° C. and the paper sheet was then applied by the touch rolls 9 onto the surface of the Yankee drier 10. The dried paper sheet was then taken up on a takeup roll 11 to produce a roll of base paper 12.

Figure 2:
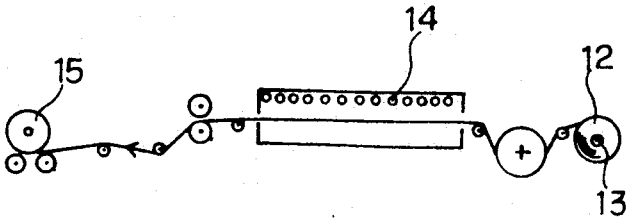
FIG. 2 is a diagrammatic view showing an oven furnace type thermal processor employed in an embodiment of the present invention.

The roll 12 was then placed on a takeup shaft 13 of an oven furnace type heat processor shown in FIG. 2. The roll 12 was introduced into the interior of a heating furnace 14 at a rate of 40 m per minute and passed therethrough as it was heated by infrared radiation to a temperature of 220° C. which is not lower than the softening point of polyethylene. After passing through the heating furnace 14, the paper sheet was taken up on a takeup roll 15 to produce the paper sheet for making confidential postcards.

Figure 3B:
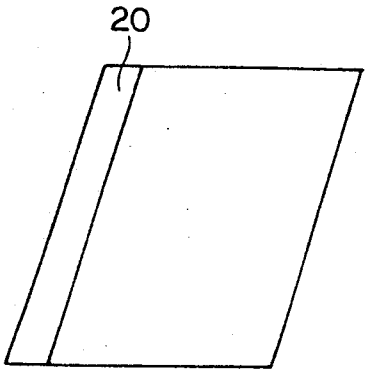
FIG. 3*b* is a diagrammatic perspective view showing that a confidential postcard obtained by a process of the present invention is folded and superimposed upon itself.

The produced paper sheet for making postcards was then cut to a size of 20×15 cm, as shown in FIG. 3*a*, and a statement or message was printed on its surface. The paper sheet was then folded upon itself, as shown in FIG. 3*b*, so that the printed side was hidden from view and a zone free of superposition 20 was formed along the left side edge. The paper sheet thus folded upon itself was heated and pressurized at 180° C. under 1.13 kg/cm (4.8 kg/cm$^2$) for two seconds to cause the printed surfaces to adhere each other. The adhering sides were then peeled off from each other at the zone free of superposition 20. The sides bearing the printing were found to be completely free from injuries.

EXAMPLE 2

The paper sheet for confidential postcards was prepared in the same way as in Example 1, except that the feed liquid paper material produced in accordance with Reference Example 2 was used in place of that produced in accordance with Reference Example 1, and that the radiation of infrared rays at the heating furnace 14 was performed at 130° C. which is not lower than the softening point of polyester.

The produced paper sheet for making confidential postcards was caused to adhere in the same way as in Example 1, except that the paper sheet was heated and pressurized at 180° C. and under 0.94 kg/cm (4 kg/cm$^2$) for three seconds, and the adhering sides of the sheet were then peeled from each other. The sides bearing the printing were found to be completely free from injuries.

EXAMPLE 3

The paper sheet for confidential postcards was prepared in the same way as in Example 1, except that the feed liquid paper material produced in accordance with Reference Example 3 was used in place of that produced in accordance with Reference Example 1, and that the radiation of infrared rays at the heating furnace 14 was performed at 180° C. which is not lower than the softening point of polypropylene.

The produced paper sheet for making confidential postcards was caused to adhere in the same way as in Example 1, except that the paper sheet was heated and pressurized at 190° C. and under 0.94 kg/cm (4 kg/cm$^2$) for three seconds, and the adhering sides of the sheet were then peeled from each other. The sides bearing the printing were found to be completely free from injuries.

COMPARATIVE EXAMPLE 1

A paper sheet for making confidential postcards was produced in the same way as in Example 1, except using the feed liquid paper material prepared in accordance with Reference Example 4, and the produced paper sheet was caused to adhere provisionally and subjected to a peeling test. It was found that the paper sheet could adhere provisionally but was low in adhesion strength and could be readily peeled off so that it could not be employed as the paper sheet for making the confidential postcard.

COMPARATIVE EXAMPLE 2

A paper sheet for making confidential postcards was produced in the same way as in Example 1, except using the feed liquid paper material prepared in accordance with Reference Example 5, and the produced paper sheet was caused to adhere provisionally and subjected to a peeling test. It was found that a higher adhesion strength was developed at the time of provisional adhesion such that it was difficult to peel off the adhering sides from each other, and that, when the adhering sides were peeled off forcibly from each other, the printing was peeled off simultaneously so that it was indicated that the paper sheet could not be used as the paper sheet for a confidential postcard.

COMPARATIVE EXAMPLE 1

A paper sheet for making confidential postcards was produced in the same way as in Example 1, except that the heating by the thermal processor shown in FIG. 2 was not carried out, and the produced paper sheet was caused to adhere provisionally and subjected to a peeling test. It was found that, since the polyethylene fibers were not softened while retaining the fiber shape, the printing was peeled off at the same time when the superposed portions of the sheet were peeled off, so that the paper sheet could not be used as the paper sheet for making a confidential postcard.

COMPARATIVE EXAMPLE 4

A paper sheet for making confidential postcards was produced in the same way as in Example 1, except that the heating by the thermal processor shown in FIG. 2 was carried out at a temperature of 100° C. which is lower than the softening point of the polyethylene fibers.

The produced paper sheet was caused to adhere provisionally and subjected to a peeling test. As a result, since the polyethylene fibers were not softened, the sheet adhered completely so that it was found that the sheet could not be used.

Although the present invention has been described with reference to the specific examples, it should be understood that various modifications and variations can be easily made by those skilled in the art without departing from the spirit of the invention. Accordingly, the foregoing disclosure should be interpreted as illustrative only and is not to be interpreted in a limiting sense. The present invention is limited only by the scope of the following claims.

What is claimed is:

1. A process for preparing a confidential postcard comprising the steps of:

(a) dehydrating a starting paper material containing 25 to 45% by weight of fibers of a thermoplastic resin and 55 to 75% by weight of fibers of a natural plant to thereby form a paper layer;

(b) heating, during or after drying, the paper layer at a temperature not lower than a softening point of said thermoplastic resin fibers to thereby obtain a paper sheet in which said fibers of the thermoplastic resin retain fiber shape and are entangled with said fibers of the natural plant;

(c) inscribing a statement to be kept confidential on said paper sheet;

(d) superposing said paper sheet to conceal said statement; and (e) attaching provisionally said superposed paper sheet by heating under pressure at a temperature not lower than a softening point of said thermoplastic resin fibers to obtain said confidential postcard, whereby the confidential postcard is capable of being peeled off with said statement on said paper sheet being left intact.

2. A process according to claim 1 wherein said thermoplastic resin is selected from the group consisting of polyvinyl alcohol, polyvinylidene, polyvinyl chloride, polyacrylonitrile, polyethylene, polypropylene, polyamides, polyesters, polyurethane, polyalkylene paraoxybenzoate, polyvinyl pyrrolidone and mixtures thereof.

3. A process according to claim 1 wherein said fibers of said natural plant are selected from the group consisting of wood fibers, seed wool fibers, bast fibers, leaf fibers, fibers of the Graminede family and mixtures thereof.

4. A process according to claim 1 wherein said natural plant is selected from the group consisting of needle-leaf trees, broad-leaf trees, cotton, kapok, mitsu-mata, paper mulberry, daphne odora, mulberry trees, jute, flax, hemp, China grass, ramie, Manila hemp, sisal, rice plant straws, rice hulls, bamboo, bagasse, esparto and mixtures thereof.

5. A process according to claim 1 wherein said starting paper material further contains up to 40 parts by weight of a filler to 100 parts by weight of the sum of said fibers of thermoplastic resin and said fibers of natural plant.

6. A process according to claim 5 wherein said filler is selected from the group consisting of calcium carbonate, magnesium carbonate, calcium magnesium carbonate, silicate, silicic acid, aluminum hydrate, barium sulfate, calcium sulfate, calcium sulfite, titanium dioxide, zinc pigments and mixtures thereof.

7. A process according to claim 1 wherein said starting paper material further contains an additive selected from the group consisting of fillers, flocculants, defoaming agents, drier peeling agents and mixtures thereof.

8. A process according to claim 1 wherein, before said step (a), said fibers of the thermoplastic resin and said fibers of the natural plant are dispersed uniformly separately in water and mixed together to produce said starting paper material.

9. A process according to claim 1 wherein said starting paper material contains 0.1 to 0.5% by weight of said fibers of said thermoplastic resin and said fibers of said natural plant.

10. A process according to claim 1 wherein, in said step (d), the paper sheet is superposed by folding said sheet upon itself at least once.

11. A process according to claim 1 wherein, in said step (d), the paper sheet is superposed by applying at least two paper sheets one on another.

12. A process according to claim 1 wherein, in said step (d), said paper sheet is provided with a free end portion not superposed for easily peeling off the confidential postcard.

13. A process according to claim 1 wherein, in said step (e), said superposed paper sheet is pressurized under 0.1 to 3.0 kg/cm for 0.2 to 3 seconds.

14. A process according to claim 1 wherein, in said step (e), said superposed paper sheet has at least an end edge portion not provisionally attached for easily peeling off the confidential postcard.

* * * * *